US005198811A

United States Patent [19]

Potter et al.

[11] Patent Number: 5,198,811

[45] Date of Patent: Mar. 30, 1993

[54] VEHICLE COMMUNICATION SYSTEM USING EXISTING ROADWAY LOOPS WHEREIN THE PHYSICAL INTEGRITY OF THE LOOP IS KEPT INTACT

[75] Inventors: Thomas Potter, Los Alamitos; Thomas W. Seabury, Diablo, both of Calif.

[73] Assignee: Detector Systems, Inc., Stanton, Calif.

[21] Appl. No.: 691,199

[22] Filed: May 16, 1991

Related U.S. Application Data

[63] Continuation of Ser. No. 462,890, Dec. 28, 1989, Pat. No. 5,089,815, which is a continuation of Ser. No. 47,833, May 8, 1987, abandoned.

[51] Int. Cl.[5] ..... G08G 1/09

[52] U.S. Cl. ..... 340/905; 340/941; 455/41; 455/99

[58] Field of Search ..... 340/902, 903, 904, 905, 340/991, 992, 993, 996, 989, 825.54, 825.71, 941; 455/41, 54, 55, 99

[56] References Cited

U.S. PATENT DOCUMENTS 3,609,247 9/1971 Halstead ..... 455/41

4,529,982 7/1985 Karlstrom et al. ..... 340/991

*Primary Examiner*—Jin F. Ng

*Assistant Examiner*—Jeffery A. Hofsass

*Attorney, Agent, or Firm*—Townsend & Townsend

[57] ABSTRACT

A method and system for transferring information between a moving vehicle and a stationary information location having a vehicle detector system with a loop antenna by using the loop antenna as either the receiving antenna for signals transmitted from a moving vehicle or as the transmitting antenna for signals generated by a transmitter located at the vehicle detector site for transfer to a receiver mounted on a moving vehicle. The information is encoded on a carrier having a frequency outside the normal frequency range of the vehicle detector system, preferably by interrupted carrier pattern processing.

16 Claims, 7 Drawing Sheets

VEHICLE COMMUNICATION SYSTEM USING EXISTING ROADWAY LOOPS WHEREIN THE PHYSICAL INTEGRITY OF THE LOOP IS KEPT INTACT

This is a continuation of application Ser. No. 462,890 filed Dec. 28, 1989, now U.S. Pat. No. 5,089,815; which is a continuation of Ser. No. 047,833, now abandoned, filed May 8, 1987.

STATEMENT OF RELATED CASE

This invention is related to the invention disclosed and claimed in commonly assigned, co-pending patent application Ser. No. 854,376, filed Apr. 21, 1986, now U.S. Pat. No. 4,731,867 for "Vehicle Communication System Using Existing Roadway Loops".

BACKGROUND OF THE INVENTION

This invention relates to communication systems for transferring information between a moving vehicle and a stationary location.

Systems are known which provide the capability of exchanging information between a stationary location and a moving vehicle, such as an automobile, truck, bus, emergency vehicle or a railroad car. Such systems typically employ either some type of modulated or encoded light radiation (such as the light based vehicle preemption system) or r.f. signals encoded with appropriate information and transmitted using appropriate transmitting and receiving antennae. An example of the latter type of communication system is described in U.S. Pat. No. 3,609,247 issued Sep. 28 1971. Such known systems have been proposed for use, and in many cases actually used, in a wide variety of signalling applications. Examples of such applications are preempting the normal traffic intersection signal light control sequence in favor of an emergency vehicle (such as a fire truck, ambulance or police car); detecting the identity of railroad cars, buses and other vehicles passing a particular location; and a wide variety of other vehicle identification and control functions.

Aside from the expected technological difficulties in designing and implementing useful communication systems involving a stationary component and a moving component, perhaps the major deterrent factor to the wide spread implementation of vehicle-stationary location communication systems has been the cost of installing and maintaining the stationary location antenna element. The inductively coupled system shown in the above-referenced '247 U.S. patent, for example, requires the installation of a specially designed coaxial trunk cable along the roadbed to enable the communication of information between the moving vehicle and the stationary sites. Other systems employ transmitting-/receiving antennae mounted in roadside boxes, which are not only costly to erect but also vulnerable to vandalism. Still other systems employ inductive loops permanently embedded in the roadbed or along the edge of the roadbed. which are specially designed for use in the communication system. Such embedded loop antennae are extremely costly to install, and the installation process usually results in the disruption of vehicular traffic and danger to the workmen performing the installation.

Efforts in the past to provide a vehicle communication system devoid of the above disadvantages have not met with success.

SUMMARY OF THE INVENTION

The invention comprises a system and method for affording communication between a moving vehicle and a stationary location which eliminates the requirement for a separate, dedicated antenna at the stationary site, while affording a wide range of communication and control functions between a moving vehicle and a stationary site.

The invention employs the loop antenna of any already installed vehicle detector system as the stationary site transmitting or receiving antenna, without interfering with the normal operation of the vehicle detector system.

From a system standpoint, the invention comprises a communication system for enabling transfer of information between a vehicle and a stationary information location, the system comprising a vehicle mounted transmitter or receiver means (or both) for enabling carrier transmission and/or reception of preselected information signals over a relatively small range; and stationary receiver or transmitter means (or both) for receiving the information signals transmitted by the vehicle mounted transmitter means and/or transmitting the information signals to the vehicle mounted receiver means when within this relatively small range, the stationary receiver or transmitter means including the vehicle detector system loop antenna, which is part of a closed loop circuit for sensing received signals and broadcasting transmitter signals. The vehicle mounted or stationary transmitter means preferably comprises means for generating an encoded carrier frequency signal lying within a transmitting frequency range different from the frequency range of the vehicle detector system loop signals: a suitable transmitting antenna, which is a separate antenna for the vehicle mounted version, or the vehicle detector system loop antenna for the stationary version; and means coupled to the generating means and the transmitting antenna for amplifying the encoded carrier frequency signals. For the stationary version, the coupling means couples the output of the generating means to the vehicle detector loop antenna without disturbing the physical integrity of the closed loop circuit so that the preselected information signal can be transferred via the vehicle detector loop antenna to the vehicle mounted receiver means without adversely affecting the operation of the vehicle detector system.

The transmitter generating means preferably includes an oscillator, means for generating a carrier source signal, means for converting the carrier source signal to a carrier signal lying within the transmitting frequency range, and encoder means for imparting the preselected information signals to the carrier signal. The converting means may also include means for generating a clock signal for the encoder means for the carrier source signal.

The vehicle mounted receiver means includes a vehicle mounted antenna, which may be a separate antenna or the vehicle mounted transmitter antenna and means for distinguishing the preselected information signals from other signals (such as RFI or conventional vehicle detector signals). The stationary receiver means includes means for distinguishing the preselected information signals from conventional vehicle detector signals present in the vehicle detector system loop antenna. The distinguishing means in each type of receiver means preferably includes filter means having a signal pass band within the frequency range of the transmitted preselected information signals so that the other signals (e.g., the conventional vehicle detector signals in the vehicle detector loop) are rejected by the filter means. In a specific embodiment of the system in which the preselected information signals are generated at a predetermined frequency, the distinguishing means further includes an amplifier means coupled to the output of the filter means, a narrow band filter means for passing signals having the predetermined frequency, and detector means for converting those signals passing through the narrow band filter means to a signal form compatible with an associated control logic circuit. In one specific application of the system, the preselected information signals transmitted by the vehicle mounted transmitter identify a traffic signal preemption vehicle, and in this specific embodiment the associated control logic circuit in the stationary receiver means generates a traffic signal preemption enabling signal for the vehicle detector system in response to receipt of the preemption vehicle identification signals from the detector means. In another specific application of the system, the preselected information signals transmitted by the stationary transmitter means identify a traffic coordinate location (e.g., a street intersection), and in this specific embodiment the vehicle mounted associated control logic circuit stores the traffic coordinate location signals along with a time of day signal generated by a vehicle mounted real time clock circuit for use in creating a time versus location profile for the vehicle route.

The system may be configured in either a unidirectional or a bidirectional mode. In one unidirectional mode, the transmitter means is mounted on the vehicle, and the receiver means is located at the stationary location adjacent the vehicle detector loop antenna. In the other unidirectional mode, the transmitter means is located at the stationary location, and the receiver means is located on the vehicle to supply information from the stationary location to the vehicle. In the bidirectional mode, both the vehicle and the stationary location are provided with a transmitter means and a receiver means so that information can be supplied in both directions. In the bidirectional mode configuration, switch means are provided to alternately connect the transmitter means and the receiver means to the corresponding antenna.

By eliminating the requirement for a separate, dedicated stationary site antenna, the invention can be deployed at relatively low cost and relatively quickly wherever a functional vehicle detector system loop antenna can be found. In addition, since loop detectors are always installed in association with other electronic circuitry the stationary site circuitry employed with the invention can simply be included in the same housing or in a housing adjacent to the vehicle detector circuitry.

For a fuller understanding for the nature and advantages of the invention, reference should be had to the ensuing detailed description taken in conjunction with the accompanying drawings.

DESCRIPTION OF THE PREFERRED EMBODIMENTS

Figure 1:
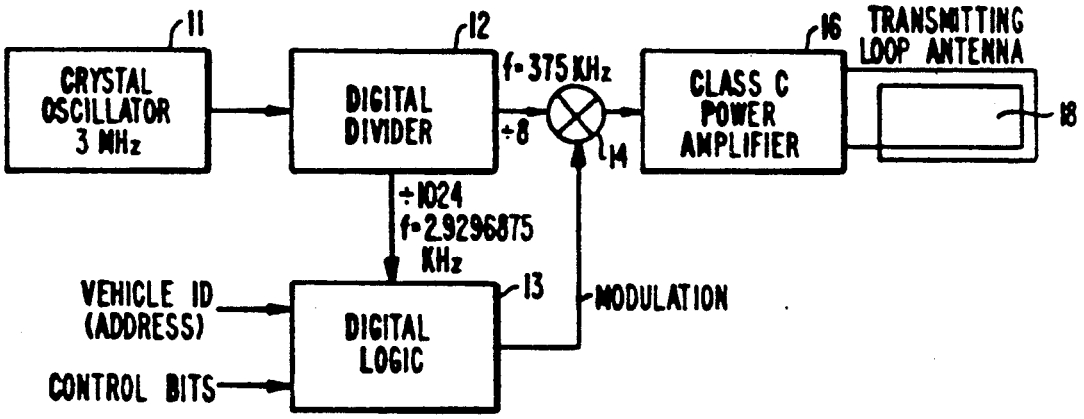
FIG. 1 is a block diagram of a transmitter portion of a system incorporating the invention and configured as a vehicle-to-stationary site unidirectional system.
Figure 2:
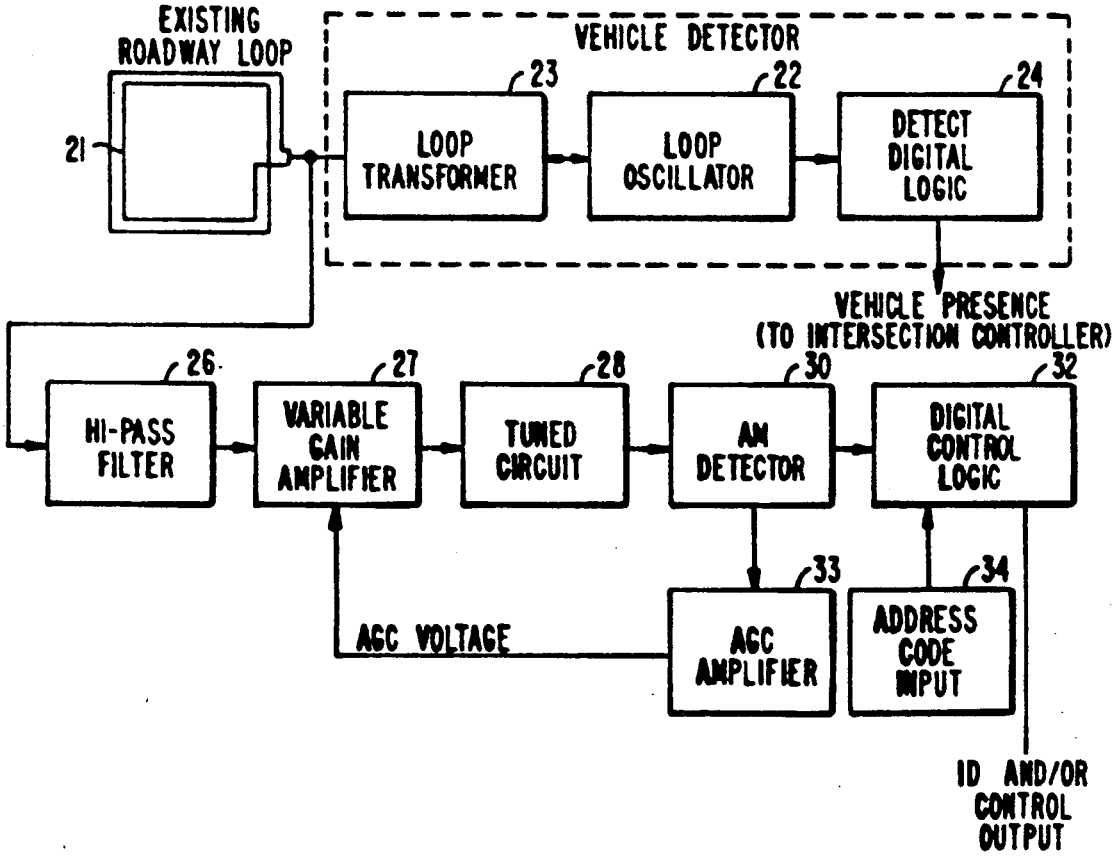
FIG. 2 is a block diagram of a receiver portion of a system incorporating the invention and configured as a vehicle-to-stationary site unidirectional system.

Turning now the drawings. FIGS. 1 and 2 illustrate, respectively, a transmitter and a receiver portion of a system embodying the invention and configured as a vehicle-to-stationary site unidirectional system. In the transmitter shown in FIG. 1 in block diagram form, a carrier source signal, illustrated as a crystal controlled oscillator 11, generates a carrier source signal which is coupled to the input of a digital divider 12. Divider 12 divides down the input signal to a transmit carrier frequency signal of predetermined value (375 Khz in the preferred embodiment).

A digital logic circuit 13 accepts preselected information in digital form and converts this information to a modulation signal, which is coupled to a summing circuit 14. The divider 12 also provides a clock signal for the digital logic circuit 13.

The modulated carrier signal output from the summing circuit 14 is amplified in a power amplifier circuit 16 and coupled to a transmitting loop antenna 18.

The information input to the digital logic circuit 13 is illustrated as a vehicle identification number and digital control information (labelled CONTROL BITS). The vehicle identification number may be unique to a specific vehicle (for example in an application in which the object is to monitor the passage of specific vehicles through a checkpoint). or the vehicle identification may be that of a special class of vehicles (such as ambulances in a given urban area, when used in a preemption application). The control bit information may serve to identify the type of information being supplied (e.g.. a vehicle identification number, a preemption request, an identification of the address data as an odometer reading, or any other suitable control function).

The transmitting power for the transmitter of FIG. 1 should be relatively low so that the signal will have a relatively small range, on the order of five feet. The use of relatively low transmitting power ensures that the transmitted signal will not interfere with any other r.f. signals in the region of the vehicle. In addition, to further shield the transmitted signals from interfering with other electromagnetic radiation, the transmitting loop antenna 18 is preferably mounted on the underside of a vehicle (e.g., underneath the front bumper). In one particular embodiment, the transmitting loop antenna 18 comprises a four turn coil mounted on a six inch by nine inch printed circuit board encapsulated in plastic or some other suitable protective material.

With reference to FIG. 2, the receiver at the stationary information site is coupled to an existing vehicle detector loop antenna 21 forming part of a closed loop circuit. The conventional vehicle detector system shown in the upper portion of FIG. 2 includes a loop oscillator 22 which is normally tuned to a resonant frequency using a fixed capacitive element. The oscillator 22 is coupled by means of a loop transformer 23 to the loop antenna 21. Antenna 21 consists of one or more turns of wire installed in relieved portions of the roadway at an appropriate location (such as an intersection, a driveway entrance, a driveway exit or the like). The area of the loop antenna 21 is chosen to cover the area of the roadway where the presence of a vehicle is to be detected.

A typical vehicle detector system such as that illustrated in FIG. 2 operates on the principle of monitoring the resonant frequency of the loop network. This is accomplished by providing an excitation voltage to the loop and monitoring the loop for frequency changes. The presence of a metal body, (such as an automobile) in the area of the loop 21 causes the inductance of the loop to decrease over the inductance value when a metal body is absent. This decrease in inductance causes the resonant frequency of the oscillator 22 to increase. A digital logic circuit 24 measures any change in the frequency of the loop oscillator 22 and generates a vehicle presence signal whenever the frequency has changed by a preselected amount. This vehicle presence signal is then coupled to follow-on digital electronic devices, such as an intersection controller used to control the timing of intersection signal lights, an entrance gate or an exit gate (or both) from a parking lot, and other applications.

Vehicle detector systems are designed to oscillate over a relatively wide range of frequencies, depending on several different parameters, such as loop configuration, cable lengths, and other parameters. Typically, the range of operating frequencies lies between about 20 Khz and 150 Khz and the loop 21 always contains signals lying somewhere within this typical frequency range whenever the system is active.

In order to be able to use the existing roadway loop 21 in the system according to the invention, two basic requirements must be met. First the transmission frequency of the communication system must lie outside the range of frequencies in the vehicle detector loop 21; secondly, the receiver must be able to distinguish between the vehicle detector loop signals and the transmitted information signals generated by the FIG. 1 transmitter and coupled to the roadway loop 21 by the vehicle mounted loop antenna 18 whenever the vehicle moves through the vehicle detector site.

The first requirement is met in the communication system of the invention by selecting a carrier frequency which is either substantially below or substantially above the expected range of vehicle detector loop frequencies. In the preferred embodiment, the transmitter carrier frequency is selected to be higher than the highest frequency encountered with known vehicle detector loop systems. Specifically, a frequency of 375 KHz is employed in the actual embodiment. As will be appreciated by those skilled in the art, this is substantially above the normal high frequency end of the vehicle detector loop frequency spectrum (150 KHz).

As shown in FIG. 2, the vehicle detector loop antenna 21 is coupled to the input of a high pass filter 26 without disturbing the physical integrity of the closed loop vehicle detector circuit. This filter 26 rejects signals having a frequency lying within the frequency of the loop detector signals. With the transmitting carrier frequency chosen (i.e., 375 KHz). the low frequency cut-off characteristics of high pass filter 26 are not exceedingly critical. Nonetheless. a filter design should be selected which ensures that any signal having a frequency lower than about 50 KHz should be attenuated by a factor of 6 db. The signals output from the high pass filter 26 are coupled to the input of an amplifier 27, illustrated as a variable gain amplifier, and the signals output from the amplifier 27 are coupled to the input of a tuned circuit 28. The purpose of the tuned circuit 28 is to provide additional narrow band filtering to substantially reject all signals having frequencies other than the carrier frequency of 375 KHz.

The output of the tuned circuit 28 is coupled to the input of an AM detector 30, which demodulates the carrier to recapture the original digitally encoded information. This digitally encoded information is then coupled to the input of a digital control logic circuit 32, where it is processed.

The receiver embodiment illustrated in FIG. 2 is provided with a conventional automatic gain control circuit including an AGC amplifier 33 which develops a feedback voltage for the variable gain amplifier 27. In some applications, such an automatic gain control feature can be useful in compensating for input signals varying over a relatively wide range such as 50 db. Specifically, the automatic gain control feature prevents the overloading of the detector 30 and provides nearly constant signal strength once the vehicle antenna 18 is over the roadway loop antenna 21. In other applications, the automatic gain control feature may not be necessary and may be deleted.

Figure 3:
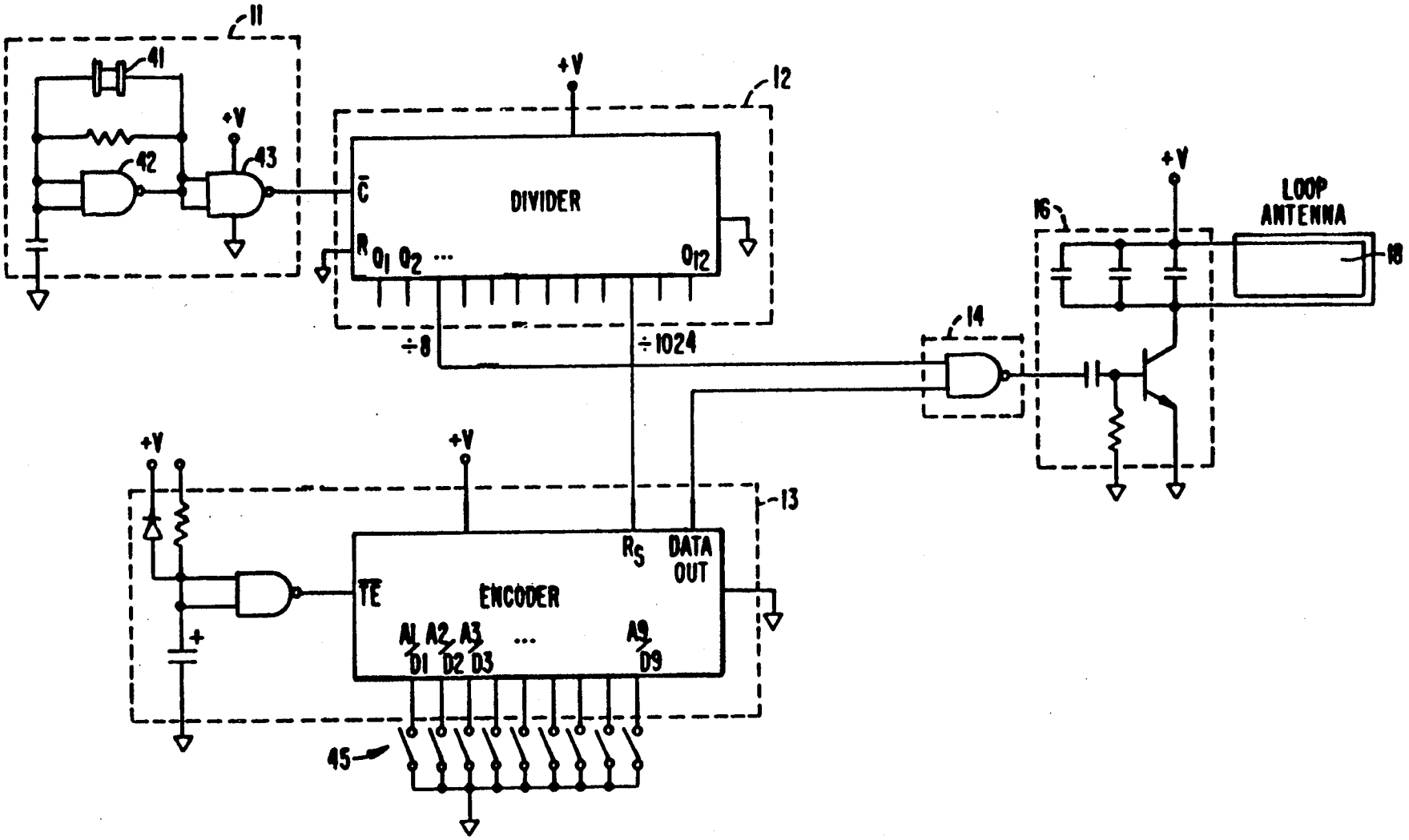
FIG. 3 is a circuit diagram of a specific embodiment of the transmitter of FIG. 1.
Figure 4:
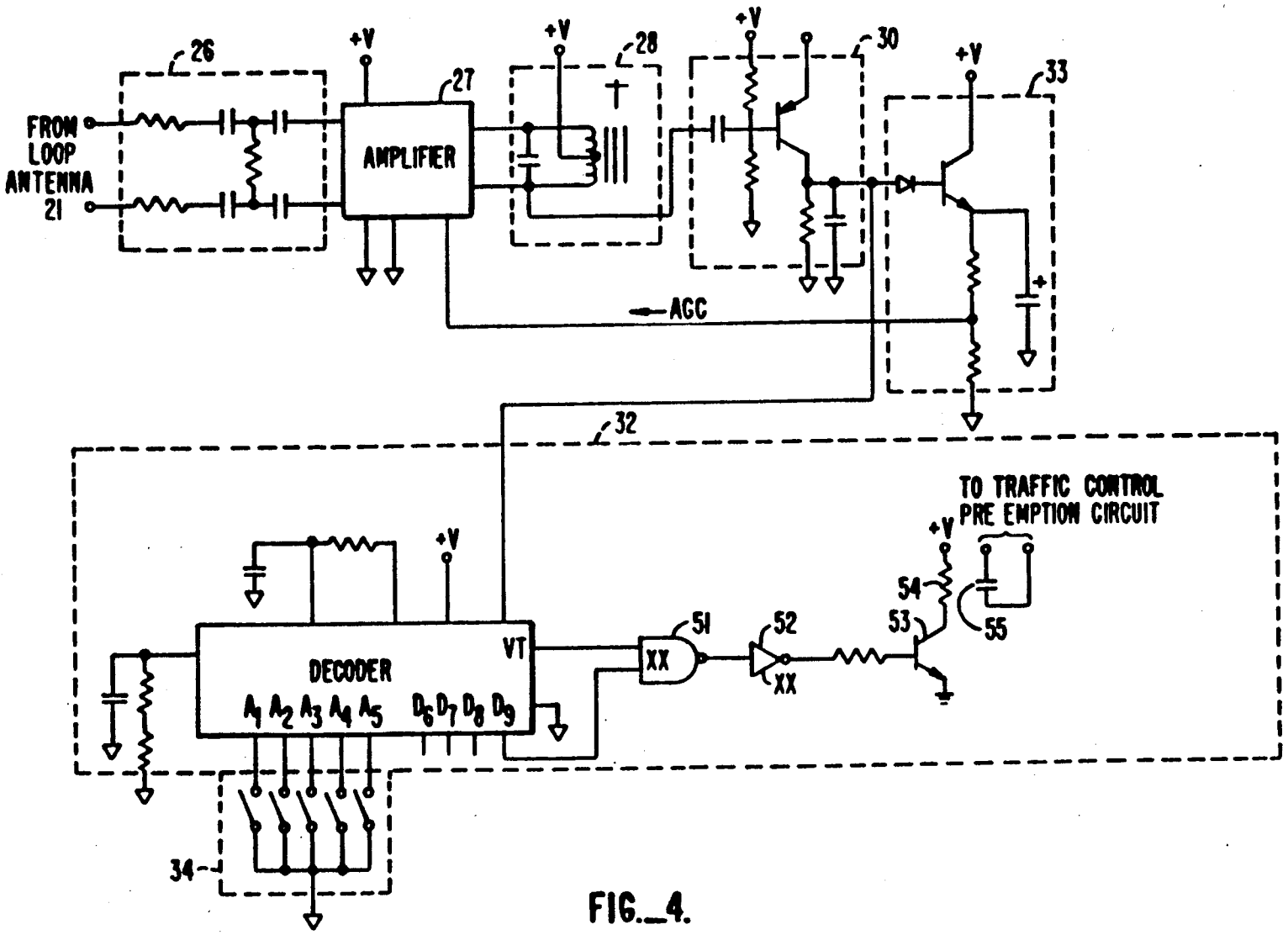
FIG. 4 is a circuit diagram of a specific embodiment of the receiver of FIG. 2.

FIGS. 3 and 4 illustrate a specific embodiment, respectively, of the vehicle mounted transmitter and the stationary receiver. With reference to FIG. 3, the transmitter includes a 4 MHz crystal 41 and a pair of NAND gates 42, 43 which provide the 4 MHz crystal controlled carrier source signal to the clock input of a CMOS type 4040 divider circuit 12. The divider circuit 12 provides a first carrier frequency output signal of 375 KHz, which is coupled as one input to a NAND gate comprising summing circuit 14. A second clock signal is coupled from the divider 12 to the clock input of an encoder circuit, which preferably comprises a Motorola type MC 145026 encoder. The transmit enable input to the encoder 13 is always active in the FIG. 3 circuit.

A plurality of address input switches designated generally with reference numeral 45 are set to a predetermined address configuration. In the preferred embodiment, only the first five switches counting from the left are used to provide the address information to specifically identify the vehicle bearing this transmitter. The encoder output is coupled as a second input to the NAND gate comprising the multiplier circuit 14. The output of circuit 14, as noted in the description of FIG. 1, is amplified by amplifier 16 and coupled to the vehicle mounted loop antenna 18.

With reference to FIG. 4, the roadway loop antenna 21 is coupled to high pass filter circuit 26, consisting of two parallel branches each having a 27K ohm input resistance and a pair of 50 picofarad capacitors coupled as shown. A 12K ohm resistor joins the two parallel branches in the manner indicated. The output of the high pass filter 26 is coupled to the input of amplifier 27, which preferably comprises a Motorola type MC1350 high frequency (video) amplifier. The output of the amplifier is coupled to the input of tuned circuit 28, which consists of a center tapped transformer with an inductance of 0.36 mH and a 500 picofarad capacitor connected as shown.

The output of tuned circuit 28 is coupled to the input of the detector 30, consisting of a 50 picofarad input capacitor, a biasing network comprising a 12K ohm (upper) and 300K ohm (lower) resistor, a type 2N3906 transistor and an RC grounded network consisting of a 12K ohm resistor and a 1500 picofarad capacitor. The output of detector 30 is coupled via a type 1N914 diode to the base input of a type 2N3904 transistor forming part of the AGC amplifier circuit 33. The feedback signal to amplifier 27 is taken from the junction of a 4.7K ohm (upper) and 12K ohm resistor network. A 10 microfarad capacitor couples the emitter electrode of the transistor to ground and acts as the AGC time constant filter.

The output of detector 30 is coupled to the data input of a Motorola type MC145027 decoder. The first five bits of the serially appearing information are compared with the address/data inputs conditioned by the switches in the address code input unit 34. When the first five incoming binary bits match the switch settings over a double scanned sequence, the VT (valid transmission) output and the D9 data output from the decoder enable a NAND gate 51, the output of which is inverted by an inverter 52 and used to turn on a power transistor 53 which pulls a relay coil 54, thereby closing a pair of relay contacts 55. The relay contacts are coupled to a traffic control preemption circuit. which initiates the proper control operation to perform signal preemption.

Figure 5:
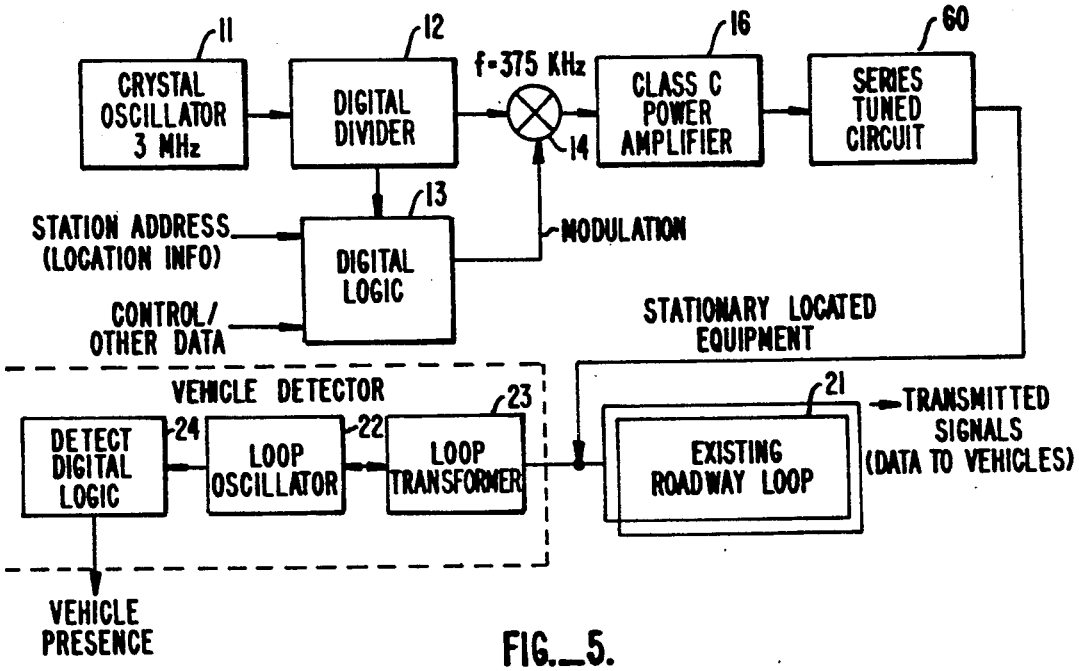
FIG. 5 is a block diagram of a transmitter portion of a system incorporating the invention and configured as a stationary site-to-vehicle unidirectional system.
Figure 6:
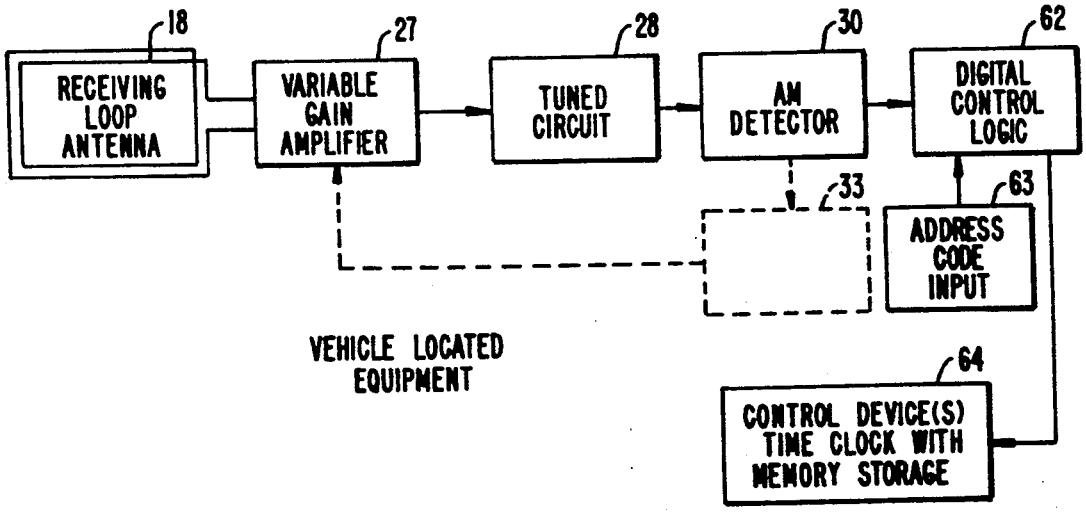
FIG. 6 is a block diagram of a receiver portion of a system incorporating the invention and configured as a stationary site-to-vehicle unidirectional system.

FIGS. 5 and 6 illustrate, respectively, a transmitter and a receiver portion of a system embodying the invention and configured as a stationary-site-to vehicle unidirectional system. The functional units illustrated in FIGS. 5 and 6 which are essentially identical to corresponding units in the system depicted in FIGS. 1 and 2 are designated with the same reference numerals. Thus, in the transmitter shown in FIG. 5 in block diagram form, a carrier source signal, illustrated as a crystal control oscillator 11, generates a carrier source signal which is coupled to the input of a digital divider 12. Divider 12 divides down the input signal to a transmit carrier frequency signal of predetermined value (375 Khz in the preferred embodiment).

A digital logic circuit 13 accepts preselected information in digital form and converts this information to a modulation signal, which is coupled to a summing circuit 14. The divider 12 also provides a clock signal for the digital logic circuit 13.

The modulated carrier signal output from the summing circuit 14 is amplified in a power amplifier circuit 16, passed through a series tuned circuit 60, and coupled to the existing roadway loop antenna 21. The conventional vehicle detector system shown in the lower portion of FIG. 5 includes a loop oscillator 22 normally tuned to a resonant frequency using a fixed capacitive element. The oscillator 22 is coupled by means of a loop transformer 23 to the loop antenna 21. A digital logic circuit 24 is coupled to the loop oscillator 22 and functions in the manner noted above.

The information input to the digital logic circuit 13 is illustrated as station address (location information) and digital control information (labelled CONTROL-/OTHER DATA). The station address information is unique to the given stationary site location, so as to uniquely identify a traffic intersection or other fixed location in a vehicle coordinate system. The control-/other data information may serve to identify the fact that the other information (at the upper input to digital logic 13) is a station address; or may simply comprise some type of verification data (such as parity. CRC or other types of error checking data).

The transmitting power considerations noted above with respect the system shown in FIG. 1 apply to the FIG. 5 transmitter as well.

With reference to FIG. 6, the vehicle mounted receiver includes a variable gain amplifier 27, a tuned circuit 28, a AM detector 30, and an optional AGC amplifier 33. Each unit functions in a manner essentially identical to that described above with reference to FIG. 2. The demodulated output from AM detector 30 is coupled to a suitable digital control logic circuit, along with address input code information 63. The output of the digital control logic 62 is coupled to follow-on utilization circuitry 64 capable of storing the information, processing same if desired, and storing the resulting processed data. For example, in a time-vs-vehicle location profile application, the station address information supplied from detector 30 to digital control logic 62 may be verified with address input code information from unit 63 to establish that the received information is a valid station address. The validated digital information may then be coupled to a microprocessor forming a portion of unit 64 and stored in memory along with a time reference generated by an on-board real time clock. Each time the vehicle passes another stationary transmitter site, fresh station address information is received, demodulated and stored in unit 64 along with an updated time reference. This type of information is repeatedly received and stored along with the real time clock information, so that a time-vs-location profile for the vehicle is created throughout the vehicle run. When the vehicle returns to a home base, the information may be read out from the unit 64 and compared with a theoretical profile to establish the efficiency of the run.

Figure 7:
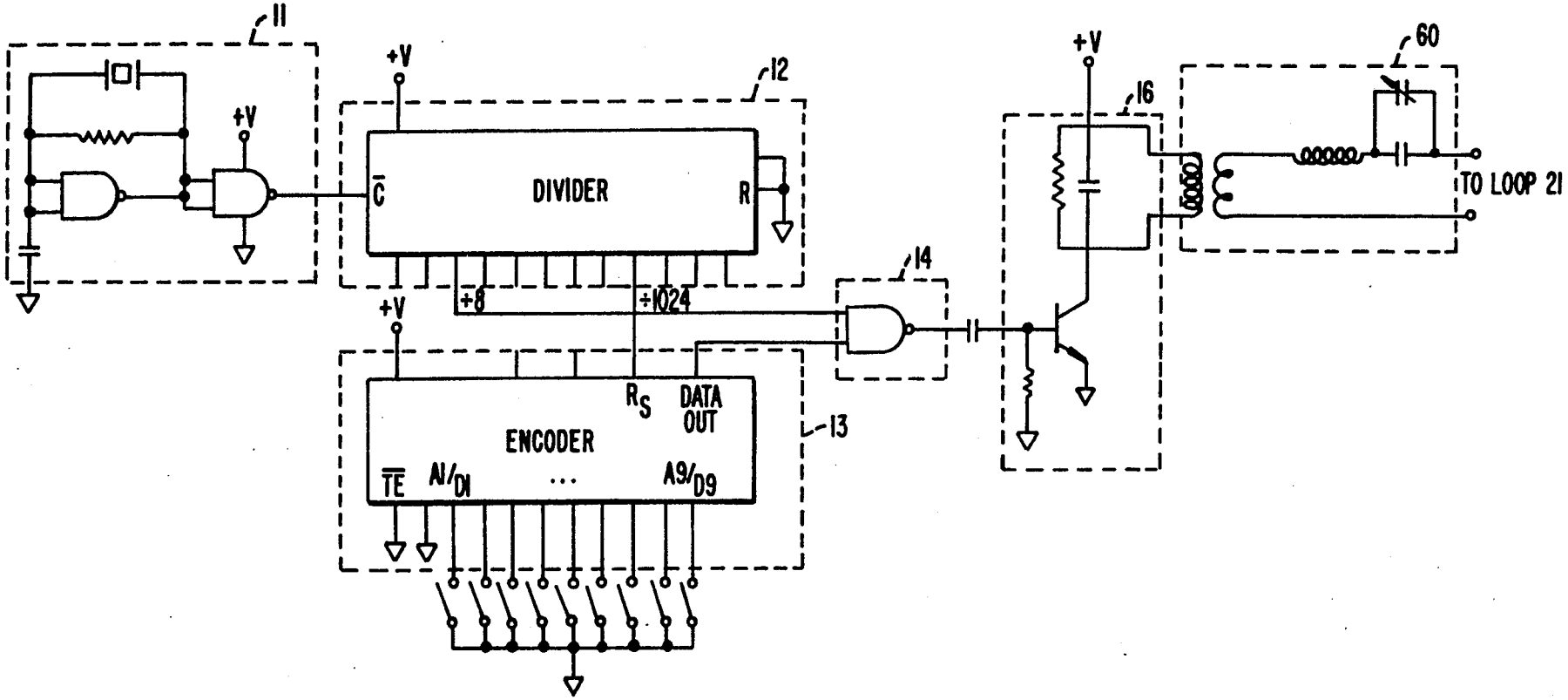
FIG. 7 is a circuit diagram of a specific embodiment of the transmitter of FIG. 5.
Figure 8:
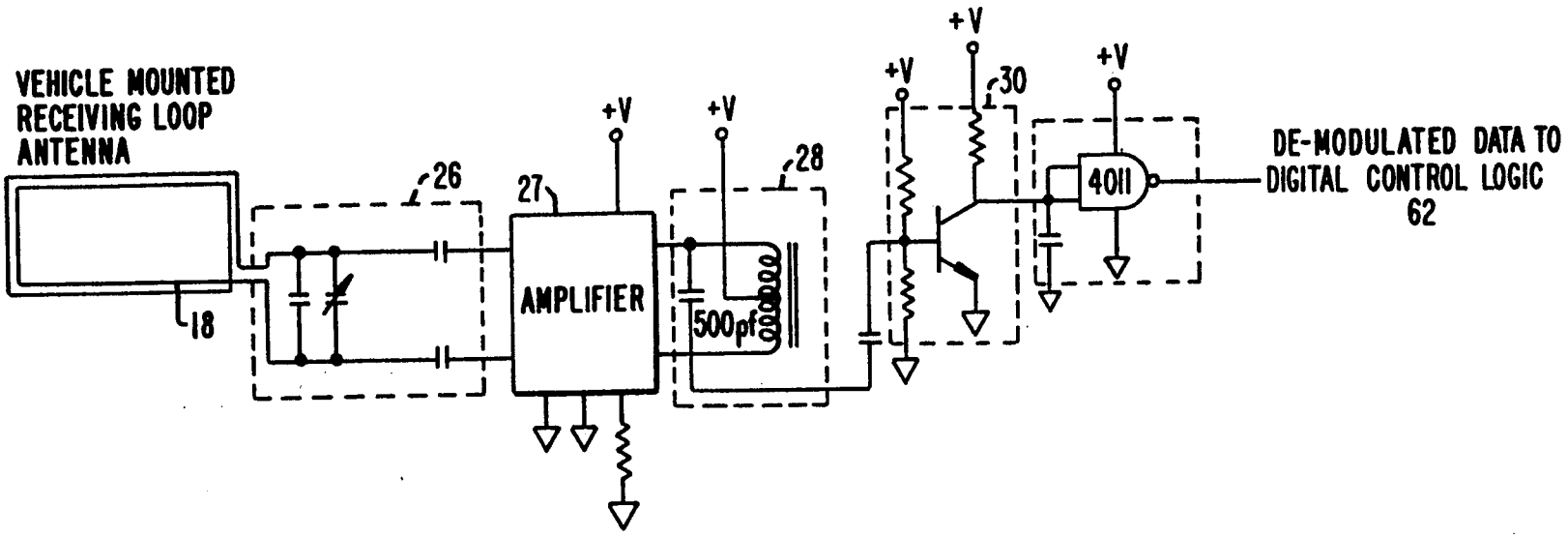
FIG. 8 is a circuit diagram of a specific embodiment of the receiver of FIG. 6.

The actual circuits corresponding to the various block element shown in FIG. 5 are illustrated in FIGS. 7 and 8, with the exception of digital control logic 62 and control unit 64. The digital control logic 62 is similar to unit 32 illustrated in FIG. 4, with the exception that the preemption circuitry is omitted. The output of the decoder portion of unit 32 is coupled to the appropriate input of a microprocessor forming a portion of control unit 64. The remaining structure of control unit 64 is conventional.

Figure 9:
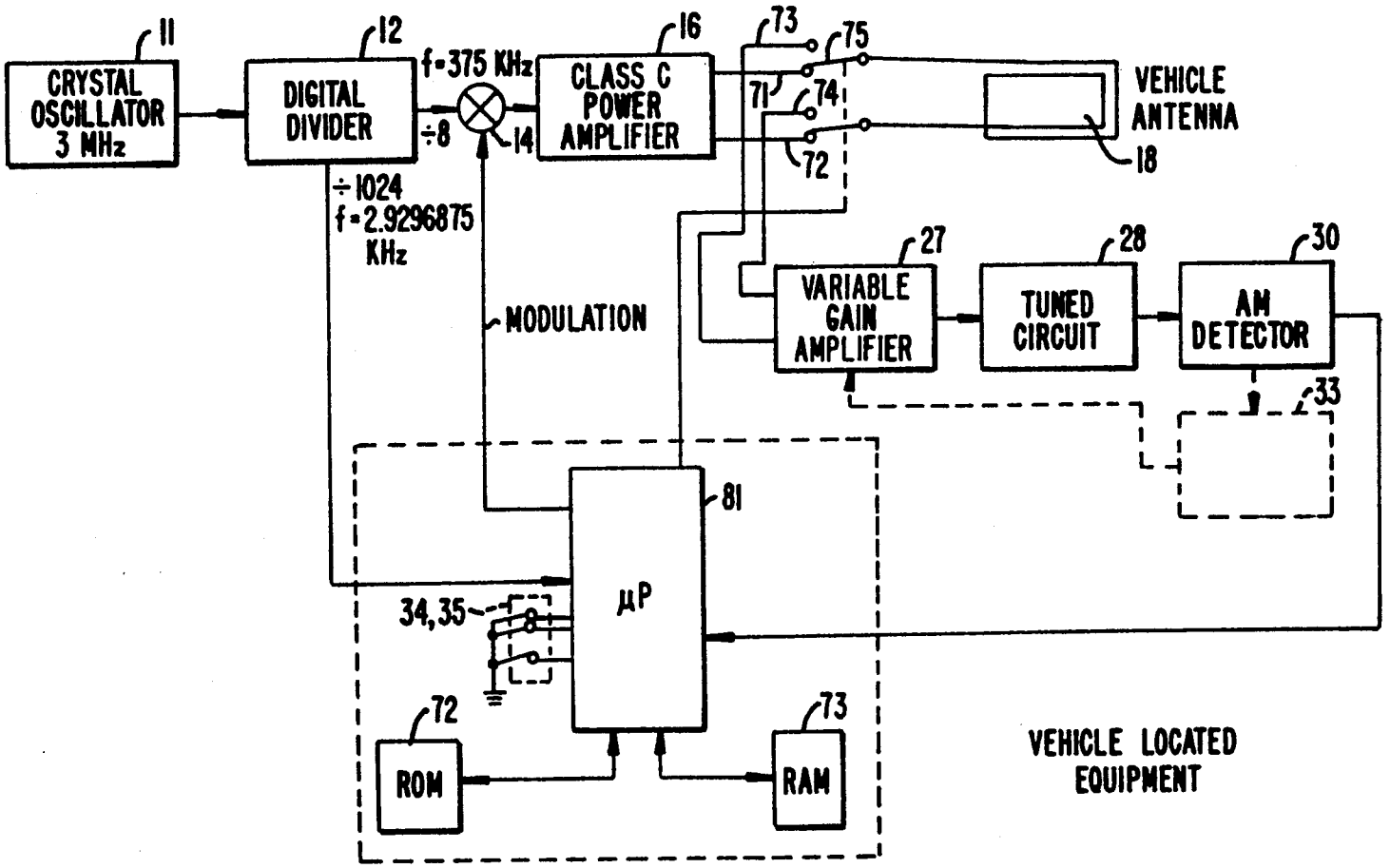
FIG. 9 is a block diagram of a bidirectional vehicle mounted transmitter/receiver system.

As noted above, the system may be configured as a full bidirectional system in which a transmitter and a receiver are each located on the vehicle and at the stationary site. In such a system, the transmitter and receiver units illustrated in FIGS. 1 and 5 are combined on the vehicle; while the receiver and transmitter units illustrated in FIGS. 2 and 6 are combined at the stationary site. In addition, appropriate switching circuitry is installed to alternately connect the appropriate antenna to either the transmitter portion of the system or the receiver portion of the system. This ensures that a given vehicle mounted unit or stationary site unit will not be simultaneously operated in both the transmit and receive modes. FIG. 9 illustrates in block diagram form a bidirectional vehicle mounted transmitter/receiver system of this type.

As seen in FIG. 9, in which like elements from the preceding Figures are designated with the same reference numerals, the output of the transmitting amplifier 16 is coupled to a first pair of switch terminals 71, 72; while the input to receiving amplifier 27 is coupled to a pair of switch terminals 73, 74. The vehicle antenna 18 is coupled to a pair of moveable switch blades 75, 76, which are controlled by means of a control output from a microprocessor 81. The clock output of digital divider 12 is coupled as a clock input to microprocessor 81; while the output of detector 30 in the receiving section is coupled as a data input to microprocessor 81. Digital identification and control information is provided to other data inputs of microprocessor 81 by means of switches 34. 45. Microprocessor 81 has an associated ROM 72 and RAM 73 for storing, respectively, program control instructions and data. Microprocessor 81, together with ROM 72, RAM 73 and switches 34, 45 perform the combined functions of digital logic 13, 32 and 64, as well as control device 64. In addition, microprocessor 81 controls the state of switch blades 75, 76 to control the operation of vehicle antenna 18 as either the transmitting antenna or the receiving antenna. The configuration of a bidirectional stationary site transmitter/-receiver system is similar to that shown in FIG. 9 and will be apparent to those of ordinary skill in the art.

The encoding technique employed in the preferred embodiments is an interrupted carrier pattern encoding method in which the single frequency carrier is turned on to indicate one binary state and turned off to indicate the other binary state. The potential on time or off time of a given bit period is specified for the system, and an appropriate number of bit periods is used to designate a multi-bit digital character. In the specific embodiment of FIGS. 1–4, a nine bit digital character is used: five bits for address information and four bits for control information. Other sized multi-bit characters may be employed and the number of bits assigned to address information and control information may be varied, as desired.

It should be understood that the preemption example illustrated in FIGS. 1–4 and the time-vs-location profile example of FIGS. 5–8 are by way of example only, and that there are many applications of the invention. Such applications include unique identification of a given vehicle in a fleet (such as a truck fleet); the identification of a class of vehicles (such as ambulances from a given metropolitan area, or a regional area); the identification of emergency vehicles in general (lumped together as a group); the transmission of information to a moving vehicle (such as route changes, emergency notification, and bus route sign changes) and other variations. In addition, the invention may be used to supply data from the vehicle to the stationary site, which data may take on a wide number of different forms. For example, the data may identify the odometer setting of a rental car which has been returned to the rental agency parking lot. Such an identification can be made by using some of the switches 45 to identify the type of information (i.e.. odometer setting), and the remaining switches to specify the actual data (i.e., mileage). The switches associated to the decoder would be correspondingly set to the same i.d. number (i.e., information type). and the outputs of the remaining data terminals would supply the actual data. As will be appreciated by those skilled in the art, the number of applications is only limited by the need for various types of information to be exchanged between a moving vehicle and a stationary site.

While the above provides a full and complete disclosure of the preferred embodiment of the invention, various modifications, alternate constructions and equivalents will occur to those skilled in the art. For example, although specific circuitry has been described, other equivalent circuits may be employed, as desired. Therefore, the above descriptions and illustrations should not be construed as limiting the scope of the invention which is defined by the appended claims.

What is claimed is:

1. A communication system for enabling transfer of information between a vehicle and a stationary information location having a vehicle detector system with a loop antenna, said loop antenna comprising part of a closed loop circuit containing conventional vehicle detector signals normally lying within a given frequency range, said system comprising:

stationary transmitter means for enabling transmission of a preselected information signal over a relatively small distance range via the vehicle detector system loop antenna; and a vehicle mounted receiver means for receiving said preselected information signal transmitted by said stationary transmitter means when within said distance range, said vehicle mounted receiver means including a loop antenna and means for distinguishing said preselected information signal from the conventional vehicle detector signals present in said vehicle detector system loop antenna which lie within the given frequency range, said transmitter means providing transmission of said preselected information signal in a transmitting frequency range different from said given frequency range of said conventional vehicle detector signals; said transmitter means including means for generating a carrier frequency signal lying within a transmitting frequency range different from the frequency range of the conventional vehicle detector signals and containing a preselected information signal, and means for coupling the output of said generating means to said vehicle detector loop antenna without disturbing the physical integrity of said closed loop circuit so that said preselected information signal can be transferred via said vehicle detector loop antenna to the vehicle mounted receiver means without adversely affecting the operation of said vehicle detector system.

2. The communication system of claim 1 wherein said distinguishing means includes filter means having a signal pass band within the transmitting frequency range of said preselected information signal so that said conventional vehicle detector signals are rejected by said filter means.

3. The communication system of claim 2 wherein said preselected information signal is transmitted at a predetermined frequency lying outside the predetermined frequency range of said conventional vehicle detector signals, and wherein said distinguishing means further includes amplifier means coupled to the output of said filter means, a narrow band filter means for passing signals having said predetermined frequency, and detector means for converting those signals passing through said narrow band filter means to a signal form conformable with an associated control logic circuit.

4. The communication system of claim 3 wherein said preselected information signal identifies the stationary information location, and wherein the associated control logic circuit stores the identification of the location as a function of time.

5. The communication system of claim 1 wherein said coupling means is coupled in parallel to said vehicle detector loop antenna.

6. The communication system of claim 1 wherein said vehicle mounted receiver means includes means for storing at least a portion of the information in the received preselected information signal.

7. For use in a communication system for enabling transfer of information between a vehicle mounted receiver stationary location having a vehicle detector system and a vehicle detector loop antenna, said loop antenna comprising part of a closed loop circuit containing conventional vehicle detector signals normally lying within a given frequency range; a transmitter means at said stationary location for enabling transmission of a preselected information signal over a relatively small distance range, said transmitter means comprising means for generating a carrier frequency signal lying within a transmitting frequency range different from the frequency range of the conventional vehicle detector signals and containing a preselected information signal, means coupled to said generating means for amplifying said carrier frequency signal, and means for coupling the output of said amplifying means to said vehicle detector loop antenna without disturbing the physical integrity of said closed loop circuit sot hat said preselected information signal can be transferred via said vehicle detector loop antenna to the vehicle mounted receiver without adversely affecting the operation of said vehicle detector system.

8. The communication system of claim 7 wherein said generating means includes an oscillator means for generating a carrier source signal, divider means for converting said carrier source signal to a carrier signal lying within said transmitting frequency range, and means for imparting said preselected information signal to said carrier signal.

9. The communication system of claim 8 wherein said divider means includes means for generating a clock signal for said imparting means from said carrier source signal.

10. The communication system of claim 8 wherein said oscillator means comprises a crystal controlled oscillator.

11. The communication system of claim 7 wherein said coupling means is coupled in parallel to said vehicle detector loop antenna.

12. The communication system of claim 7 wherein said vehicle mounted receiver includes means for storing at least a portion of the information in the received preselected information signal.

13. For use in a communication system enabling transfer of information between a stationary location and a vehicle, said stationary location including a vehicle detector system and a vehicle detector system loop antenna, said loop antenna comprising part of a closed loop circuit containing conventional vehicle detector signals normally lying within a given frequency range, said stationary location having a transmitting frequency range different from the given frequency range of the conventional vehicle detector signals, said transmitter means including means for generating a carrier frequency signal lying within a transmitting frequency range different from the frequency range of the conventional vehicle detector signals and containing a preselected information signal, and means for coupling the output of said generating means to said vehicle detector loop antenna without disturbing the physical integrity of said closed loop circuit so that said preselected information signal can be transferred to said vehicle detector system loop antenna without adversely affecting the operation of said vehicle detector system; a vehicle mounted antenna, and a vehicle mounted receiver means for converting a preselected information signal sensed by the vehicle mounted antenna to a signal representative of said preselected information signal, said receiver means comprising filter means adapted to be coupled to the vehicle mounted antenna for distinguishing said preselected information signal from the conventional vehicle detector signals present in said vehicle detector system loop antenna, and detector means for converting those signals distinguished by said filter means to a signal form conformable with an associated control logic circuit.

14. The communication system of claim 13 wherein said preselected information signal is transmitted at a predetermined frequency lying outside the frequency range of the vehicle detector system loop signals, and wherein said receiver means further includes amplifier means coupled to the output of said filter means, and narrow band filter means coupled between said amplifier means and said detector means for passing signals having said predetermined frequency.

15. The communication system of claim 14 wherein said coupling means is coupled in parallel to said vehicle detector loop antenna.

16. The communication system of claim 13 wherein said vehicle mounted receiver means includes means for storing at least a portion of the information in the received preselected information signal.

* * * * *